United States Patent [19]

Wilder et al.

[11] Patent Number: 5,007,468

[45] Date of Patent: Apr. 16, 1991

[54] FLUID DISPENSING NOZZLE CONSTRUCTION HAVING A DIAPHRAGM SUBASSEMBLY THEREIN AND METHODS OF MAKING THE SAME

[75] Inventors: Paul R. Wilder, Hamilton; James E. Kesterman, Cincinnati, both of Ohio

[73] Assignee: Dover Corporation, New York, N.Y.

[21] Appl. No.: 123,042

[22] Filed: Nov. 19, 1987

[51] Int. Cl.[5] ..... B65B 1/30

[52] U.S. Cl. ..... 141/209; 141/218

[58] Field of Search ..... 24/682; 141/392, 206, 141/207, 208, 209, 210, 211, 212, 213, 214, 215, 216, 217, 218, 219, 220, 221, 222, 223, 224, 225, 226, 227, 228, 229

[56] References Cited

U.S. PATENT DOCUMENTS

| | | | |
|---|---|---|---|
| 603,303 | 5/1898 | Washburne | 24/682 X |
| 2,582,195 | 1/1952 | Duerr | 226/127 |
| 3,233,641 | 2/1966 | Ehlers | 141/209 |
| 3,653,415 | 4/1972 | Boudot et al. | 141/208 |
| 3,756,734 | 9/1973 | Carder | 141/225 |
| 3,866,636 | 2/1975 | Lasater | 141/392 |
| 4,331,187 | 5/1982 | Trygg | 141/218 |
| 4,453,578 | 6/1984 | Wilder | 141/209 |
| 4,572,255 | 2/1986 | Rabinovich | 141/217 |
| 4,669,153 | 6/1987 | Olivieri | 24/682 X |
| 4,735,243 | 4/1988 | Ehlers | 141/392 |

*Primary Examiner*—Henry J. Recla
*Assistant Examiner*—David J. Walczak
*Attorney, Agent, or Firm*—Kinney & Schenk

[57] ABSTRACT

A fluid dispensing nozzle construction, a diaphragm subassembly therefor and methods of making the same are provided, the diaphragm subassembly comprising a pin, a diaphragm support carried by the pin, a diaphragm, and a diaphragm retainer securing the diaphragm to the pin with the diaphragm being disposed and sandwiched between the diaphragm retainer and the diaphragm suppport, the diaphragm subassembly having structure requiring the descrution of at least one part of the diaphragm subassembly when the diaphragm subassembly has the parts thereof disassembled.

8 Claims, 3 Drawing Sheets

FLUID DISPENSING NOZZLE CONSTRUCTION HAVING A DIAPHRAGM SUBASSEMBLY THEREIN AND METHODS OF MAKING THE SAME

BACKGROUND OF THE INVENTION

1. Field of the Invention

This invention relates to a new fluid dispensing nozzle construction and to a new diaphragm subassembly therefore.

2. Prior Art Statement

It is known to provide a diaphragm subassembly for use in an automatic shutoff system for a fluid dispensing nozzle construction, the diaphragm subassembly comprising a pin means, a diaphragm support means carried by the pin means, a diaphragm, and a diaphragm retainer means securing the diaphragm to the pin means with the diaphragm being disposed and sandwiched between the diaphragm retainer means and the diaphragm support means. For example, see the prior known threaded latch pin construction of the diaphragm subassembly illustrated in FIG. 1 of this application and see the threaded latch pin constructions of the diaphragm subassemblies set forth in the U.S. Pat. No. to Boudot et al, 3,653,415 and the U.S. Pat. No. to Duerr, 2,582,195.

It is also known to sonically weld together plastic parts of a latch pin construction of a diaphragm subassembly to prevent disassembling thereof. For example, see the U.S. Pat. No. to Carder, 3,757,834.

SUMMARY OF THE INVENTION

It is one feature of this invention to provide a new diaphragm subassembly for use in an automatic shutoff system of a fluid dispensing nozzle construction, the diaphragm subassembly having unique mechanical means that requires the destruction of at least one part thereof when the diaphragm subassembly has the part thereof disassembled.

In particular, it is desired that the diaphragm subassembly of an automatic shutoff system of a fluid dispensing nozzle construction be such that the same must be completely replaced by a new diaphragm subassembly should it be desired to change the diaphragm subassembly of the nozzle construction rather than permit a person to disassemble the diaphragm subassembly and then reassemble the parts after having attempted a repairing or reworking thereof.

Therefore, it was found according to the teachings of this invention that the parts of a diaphragm subassembly could be so uniquely formed that the same could be readily assembled together to form the diaphragm subassembly but then would require a dissembling of such diaphragm subassembly in such a manner that at least one of the parts of the assembled diaphragm subassembly would be destroyed when the diaphragm subassembly was being disassembled.

For example, one embodiment of this invention provides a diaphragm subassembly for use in an automatic shutoff system of a fluid dispensing nozzle construction, the diaphragm subassembly comprising a pin means, a diaphragm support means carried by the pin means, a diaphragm, and a diaphragm retainer means securing the diaphragm to the pin means with the diaphragm being disposed and sandwiched between the diaphragm retainer means and the diaphragm support means, the diaphragm subassembly having means requiring the destruction of at least one part of the diaphragm subassembly when the diaphragm subassembly has the parts thereof disassembled.

Accordingly, it is an object of this invention to provide a new diaphragm subassembly for use in an automatic shutoff system of a fluid dispensing nozzle construction, the diaphragm subassembly of this invention having one or more of the novel features of this invention as set forth above or hereinafter shown or described.

Another object of this invention is to provide a new fluid dispensing nozzle construction utilizing such a diaphragm subassembly, the nozzle construction of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
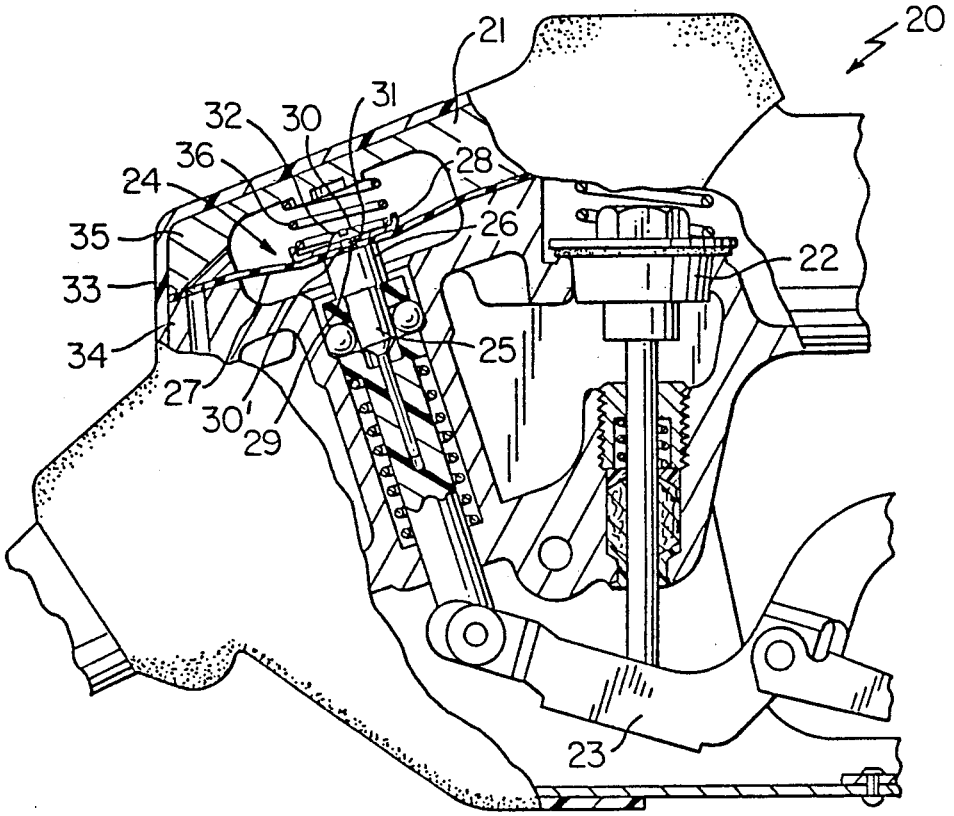
FIG.1 PRIOR ART
FIG. 1 is a fragmentary and partially broken away view of a prior art fluid dispensing nozzle construction and illustrating in cross section the prior art diaphragm subassembly therefore.

While the various features of this invention are hereinafter illustrated and described as being particularly adapted to provide a diaphragm subassembly for a fluid dispensing nozzle construction utilized for dispensing fuel into the fill pipes of the gasoline storage tanks on automobiles and the like at conventional filling stations and the like, it is to be understood that the various features of this invention can be utilized singularly or in various combinations thereof to provide a nozzle construction and a diaphragm subassembly therefore for dispensing other fluids as desired.

Therefore, this invention is not to be limited to only the embodiment illustrated in the drawings, because the drawings are merely utilized to illustrate one of the wide variety of uses of this invention.

Referring now to FIG. 1, a prior art fluid dispensing nozzle construction is generally indicated by the reference numeral 20 and comprises a housing means 21 for dispensing fluid therethrough, such as gasoline by the opening of a main valve member 22 thereof upon the actuation of a lever means 23 in a manner well known in the art, the lever means 23 being adapted to be disposed in an "on" condition thereof which will be automatically returned to an "off" position thereof by the operation of a diaphragm subassembly that is generally indicated by the reference numeral 24 in FIG. 1 and operated in a manner well known in the art. For example, see the aforementioned three U.S. Pat. Nos. 2,582,195; 3,653,415 and 3,757,834 whereby these three patents are being incorporated into this disclosure by this reference thereto.

Since the use and operation of a diaphragm subassembly 24 is well known in the art, a further discussion thereof is deemed unnecessary. However, since it is a feature of this invention to provide a new diaphragm subassembly that cannot be disassembled without the destruction of at least one part of the new diaphragm subassembly, the basic parts of the prior art diaphragm subassembly 24 will now be described in order to fully understand the features of this invention.

The prior art diaphragm subassembly 24 comprises a pin means 25, a diaphragm support means 26 carried by the pin means 25, a flexible diaphragm 27 and a diaphragm retainer means in the form of a disc 28 securing the diaphragm 27 to the pin means 25 with the diaphragm 27 being disposed and sandwiched between the disc 28 and the diaphragm support means 26, the pin means 25 threadedly receiving a threaded end 29 of a screw 30 that passes through aligned openings 30' and 31 in the diaphragm 27 and the diaphragm retaining means 28 and has an enlarged head 32 thereon that abuts the disc 28 so as to detachably secure the parts of the diaphragm subassembly 24 in the assembled relation illustrated in FIG. 1.

The thus assembled diaphragm subassembly 24 is then disposed in the automatic shutoff system of the nozzle construction 20 by having the outer peripheral portion 33 of the diaphragm 27 trapped between housing parts 34 and 35 so that a compression spring 36 can be disposed between the housing part 35 and the disc 28 to tend to urge the pin means 25 downwardly in FIG. 1.

Thus, it can be seen that the diaphragm subassembly 24 when removed from the nozzle construction 20 can readily have the parts thereof disassembled by merely unthreading the screw 30 from the threaded bore of the pin means 25.

Referring now to FIGS. 2–10, the new fluid dispensing nozzle construction of this invention is generally indicated by the reference numeral 20A and parts thereof that are similar to the previously described parts of the prior art nozzle construction 20 are indicated by like reference numerals followed by the reference letter "A".

Figure 2:
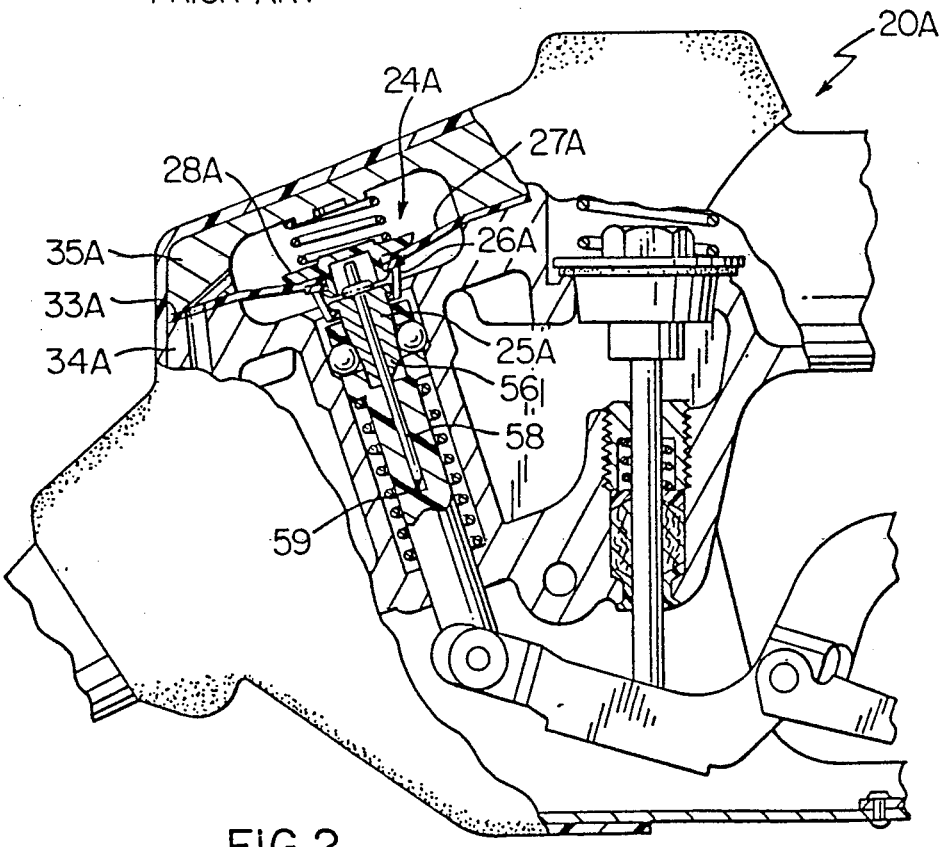
FIG. 2 is a view similar to FIG. 1 and illustrates the new fluid dispensing nozzle construction of this invention with the new diaphragm subassembly of this invention disposed therein.
Figure 3:
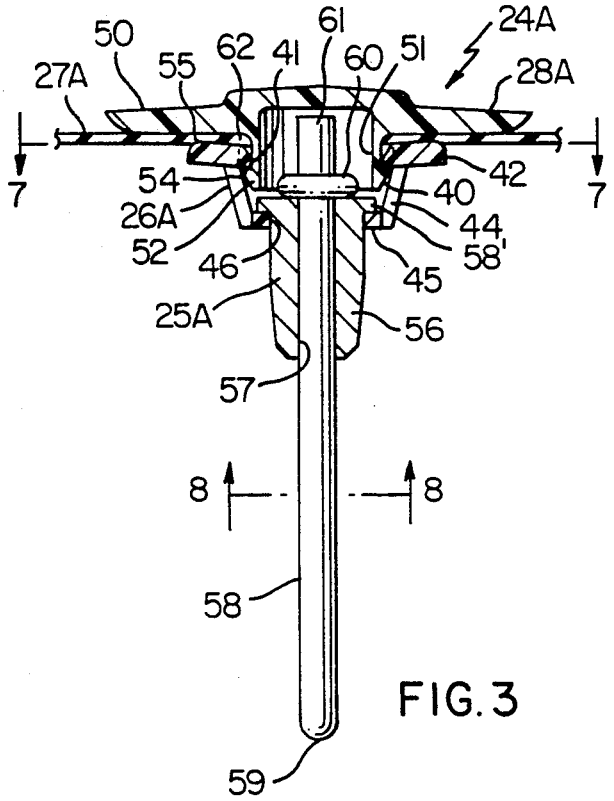
FIG. 3 is an enlarged fragmentary cross-sectional view illustrating the new diaphragm subassembly of this invention.

As illustrated in FIG. 2, it can be seen that the new diaphragm subassembly 24A of this invention generally comprises a pin means 25A, a diaphragm support means 26A carried by the pin means 25A, a diaphragm 27A, and a diaphragm retainer means in the form of a disc 28A securing the diaphragm 27A to the pin means 25A with the diaphragm 27A being disposed and sandwiched between the disc 28A and the diaphragm support means 26A, the new diaphragm subassembly 24A of this invention having means, as hereinafter set forth, that requires at least one of the parts of the diaphragm subassembly 24A to be destroyed when the diaphragm subassembly 24A has the parts thereof disassembled.

This feature prevents a person from taking apart the diaphragm subassembly 24A of this invention and then reassembling the same with the same parts thereof for the reasons previously set forth.

The means of the diaphragm subassembly 24A of this invention for requiring the destruction of at least one of the parts of the diaphragm subassembly 24A when the diaphragm subassembly 24A has the parts thereof disassembled comprises snap-fit means 40 of the diaphragm retaining means 28A that is snap-fitted to snap-fit means 41 of the diaphragm support means 26A when the diaphragm retaining means 28A is assembled with the diaphragm support means 26A in a manner herein after set forth.

As illustrated in the drawings, the diaphragm support means 26A has an annular portion 42 provided with a depending tubular portion 43 that has a plurality of openings 44 passing therethrough as illustrated, the tubular portion 43 terminating at its lower end with an inwardly directed annular flange 45 that defines an opening 46 passing therethrough. The annular portion 42 of the diaphragm support means 26A has a central passageway defined by an internal annular edge 47 that is substantially circular and snap-fit means 41 thereof comprises a plurality of inwardly directed tabs or tangs 48 that extend radially inwardly from the surface 47 thereof in angularly spaced relation as illustrated, each tab 48 having a free end or edge 49 as illustrated.

Figure 4:
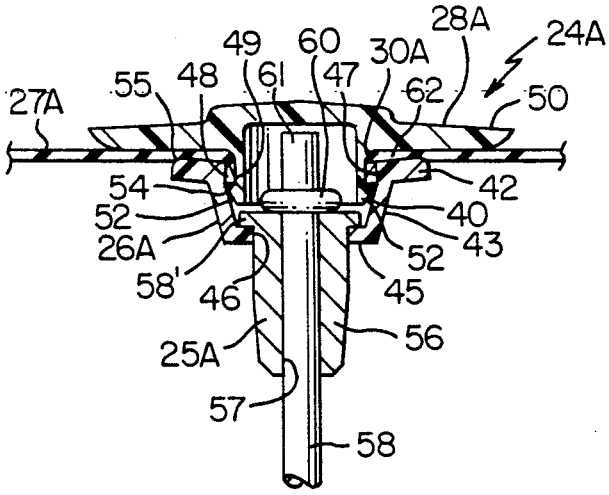
FIG. 4 is a view similar to FIG. 3 and illustrating another cross-sectional view of the diaphragm subassembly of this invention.
Figure 5:
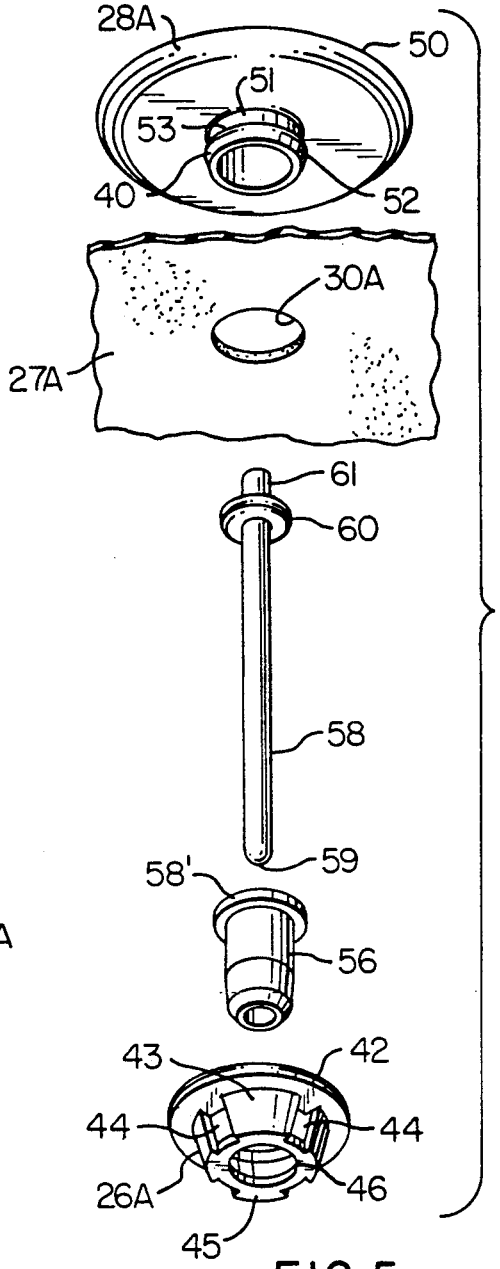
FIG. 5 is an exploded perspective view of the various parts of the diaphragm subassembly of FIG. 3.
Figure 6:
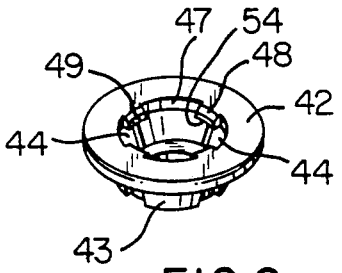
FIG. 6 is a top perspective view of the diaphragm support means of the diaphragm subassembly of FIG. 3 with FIG. 5 showing such diaphragm support means from the bottom thereof.
Figure 7:
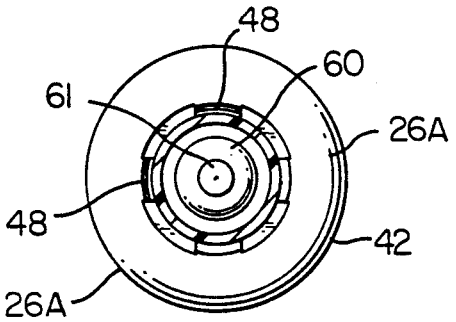
FIG. 7 is a cross-sectional view taken on line 7—7 of FIG. 3.
Figure 9:
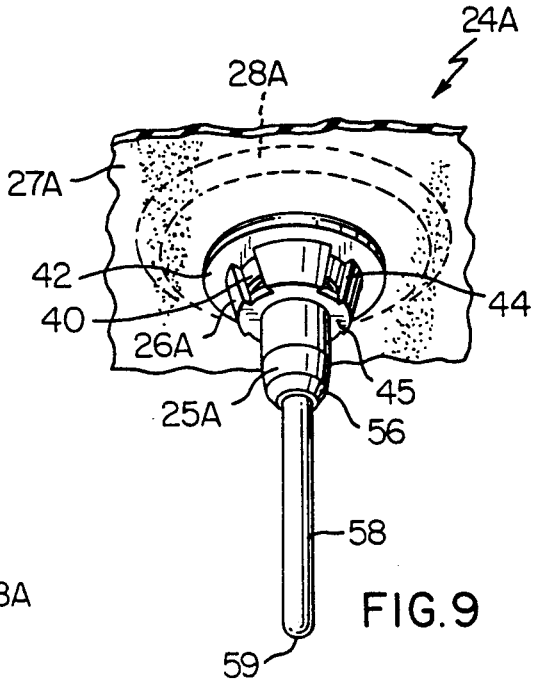
FIG. 9 is a bottom perspective view of the assembled diaphragm subassembly of FIG. 3.
Figure 8:
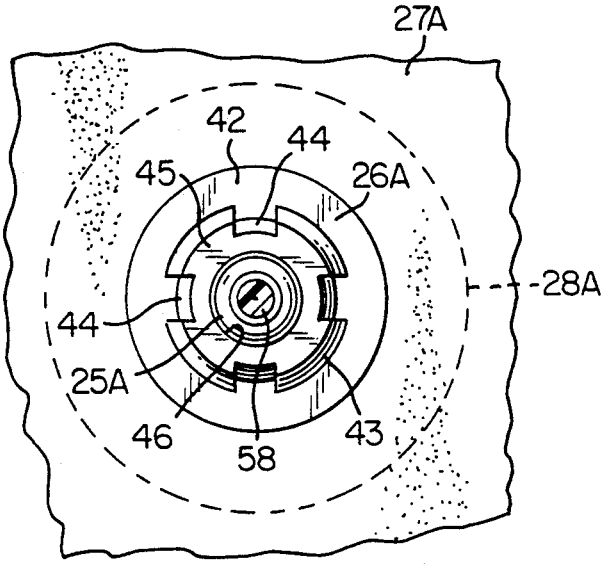
FIG. 8 is a fragmentary cross-sectional view taken on line 8—8 of FIG. 3.

The disc 28A has a substantially flat annular portion 50 and a depending tubular portion or hub 51 that terminates in an outwardly directed and beveled annular lip means 52 that has an annular shoulder means comprising a horizontal surface 53 that is adapted to snap past the free edges 49 of the tangs or tabs 48 to grip against the horizontal undersides 54 thereof when the hub 51 is telescoped into the central passageway of the diaphragm support 26A in the manner illustrated in FIG. 4. The disc 28A is thus secured to the diaphragm support means 26A at the time that the diaphragm 27A is being sandwiched between the annular portions 50 and 42 of the diaphragm retaining means 28A and the diaphragm support means 26A as illustrated in FIG. 4.

If desired, the inner peripheral portion of the annular portion 42 of the diaphragm support means 43 can be angled as illustrated in FIG. 4 to insure the full sealing relationship between its outer peripheral edge portion 55 and the diaphragm 27A in a manner well known in the art when the diaphragm retaining means 28A is secured to the diaphragm support means 26A.

The pin means 25A of the diaphragm subassembly of this invention comprises an upper generally cylindrical pin 56 that has a central opening 57 passing therethrough and provided with an outwardly directed annular abutment or shoulder means 58' at the upper end thereof. The pin means 25A includes another pin 58 that comprises a substantially elongated cylindrical rod having a rounded lower end 59 and an outwardly directed annular shoulder or abutment means 60 adjacent the upper end 61 thereof, the rod 58 being adapted to be inserted through the opening 57 in the upper pin 56 so as to have the shoulder 60 thereof rest against the upper end 58' of the pin 56 while the length of the end 61 thereof is such that the same is adapted to be fully received within the tubular portion 51 of the diaphragm retaining means 28A in the manner illustrated in FIG. 4 when the parts of the diaphragm subassembly 24A of this invention are assembled together in a manner hereinafter set forth.

While the various parts of the diaphragm subassembly 24A of this invention can be formed of any suitable material, and in any suitable manner, in one working embodiment of this invention the diaphragm retaining means 28A, the diaphragm supporting means 26A and the pin 58 are formed or molded of polymeric material, such as an acetal resin, while the upper pin 56 is formed of metallic material, such as stainless steel.

The diaphragm 27A can be formed of any suitable material and in the embodiment illustrated in the drawings, the same comprises a rubber coated nylon material that is approximately 0.020 of an inch thick.

When it is desired to assemble a diaphragm subassembly 24A of this invention from the parts thereof that have been previously described, it can be seen that the pin 58 can be inserted through the opening 57 of the upper pin 56 until the abutment means 60 of the rod 58 engages against the end 58' of the pin 56. Thereafter or before, the upper pin 56 can be disposed through the opening 46 of the diaphragm support means 26A until the flanged end 58' of the pin 56 abuts against the inwardly directed shoulder means 45 of the diaphragm support means 26A as illustrated in FIG. 4.

Thereafter, the diaphragm 27A is assembled with the diaphragm support means 26A so that the opening 30A of the diaphragm 27A can receive the tubular portion 51 of the diaphragm retaining means 28A therethrough at the time that the tubular portion 51 of the diaphragm retaining means 28A is being pressed through the upper opening 47 of the diaphragm support means 26A to cause the annular lip 52 thereof to cam and snap past the edges 49 of the tangs 48 and then have the shoulder means 53 thereof bear against the underside 54 of the tangs 48 in the manner illustrated in FIG. 4 and thereby compress the internal peripheral portion 62 of the diaphragm 27A in sandwiched compressed sealing relation between the annular portions 42 and 50 of the diaphragm support means 26A and diaphragm retaining means 28A in the manner illustrated in FIG. 4 so that the diaphragm subassembly 24A of this invention is completed in a simple and effective manner by the snap-fit relation between the diaphragm retaining means 28A and the diaphragm support means 26A.

Thereafter, the completed diaphragm subassembly 24A of this invention can be assembled in the nozzle construction 20A by having the outer peripheral portion 33A of the diaphragm 27A secured between the housing parts 34A and 35A as previously described whereby the diaphragm subassembly 24A of this invention will function in the same manner as the prior known diaphragm subassembly 20 in a manner well known in the art.

Figure 10:
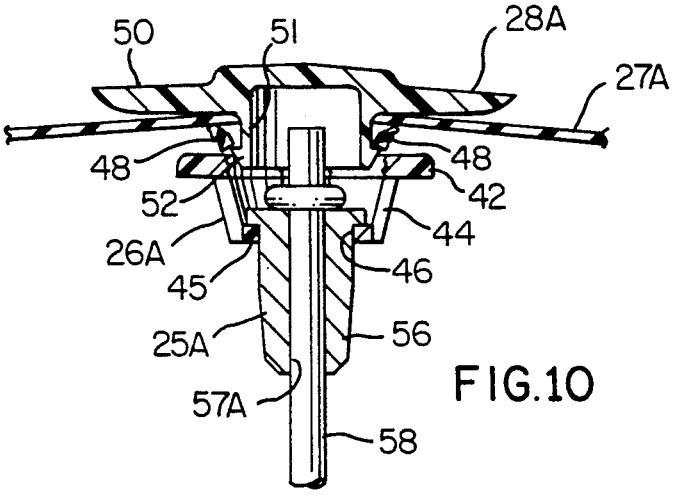
FIG. 10 is a view similar to FIG. 3 and illustrates the destruction of at least one part of the diaphragm subassembly during a disassembling thereof.

However, should a person desire to remove the diaphragm subassembly 24A of this invention and try to disassemble the same, that person while removing the diaphragm subassembly 24A from the nozzle 20A by removing the housing part 35A from the housing 34A will find that the snap-fit means 40 and 41 of the disc 28A and the diaphragm support means 26A cannot be reached externally so that in order to pry the disc 28A and the diaphragm support means 26A apart, the angular relationship of the tangs 48 and lip 52 are such that the lip 52 cannot be cammed past the tangs 48 in a disassembling direction thereof so that at least the tangs 48 will fracture from the diaphragm support means 26A in the manner illustrated in FIG. 10 whereby at least the diaphragm support means 26A will be destroyed during the disassembling operation and thereby cannot be utilized to complete a reassembling of the parts of the disassembled diaphragm subassembly 24A as the tangs 48 no longer permit a snap-fit relation with the diaphragm retaining means 28A. It may also be found that the annular lip 52 of the diaphragm retaining means 28A is also destroyed during the disassembling operation.

In any event, it can be seen that the snap-fit means 40 and 41 of the diaphragm subassembly 24A of this invention is so uniquely arranged that the same requires the destruction of at least one part of the diaphragm subassembly 24A as the parts thereof are being disassembled in a manner previously set forth.

Therefore, it can be seen that this invention not only provides a new fluid dispensing nozzle construction and a new diaphragm subassembly for use in the automatic shutoff system thereof, but also this invention provides new methods of making the same.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. A fluid dispensing nozzle comprising
a main valve,
lever means for controlling said main valve, and
automatic shut off means for disposing said lever means in an "on" condition or an "off" condition,
said shut off means including
a diaphragm assembly comprising
a diaphragm having an upper and lower surface,
a pin and
means for mounting the diaphragm on the upper end of the pin comprising first and second clamping elements between which a central portion of the diaphragm is clamped,
characterized in that
the first and second clamping elements are telescoped to a clamping position and have, respectively, cooperating snap fit connecting surfaces which are readily assembled to mount the diaphragm on the pin and which require destruction of at least one of the elements to remove the diaphragm from the pin.

2. A fluid dispensing nozzle as in claim 1 wherein
the first clamping element comprises a disc engaged with the upper surface of the central portion of the diaphragm and a central hub projecting downwardly, through said diaphragm, and
the snap fit connecting surfaces thereof are formed on said hub.

3. A fluid dispensing nozzle as in claim 2 wherein
the pin has a downwardly facing shoulder and the second clamping element comprises a diaphragm support having a disc portion engaging the lower surface of the diaphragm, and a central passageway receiving said hub and having the snap fit surfaces thereof formed in said passageway, said central passageway further having an inturned lip engaging said downwardly facing shoulder to axially position the diaphragm support relative to said pin.

4. A fluid dispensing nozzle as in claim 3 wherein the said hub has an outwardly projecting, annular tip forming the snap fit surfaces thereof, said annular lip having a horizontal upper surface and an inwardly sloping surface therebeneath, the passageway has angularly spaced, inwardly projecting tabs forming the snap fit surfaces thereof, said tabs having lower, horizontal surfaces engageable with the upper surface of said annular lip to prevent removal of the diaphragm without destruction of one of the mounting elements.

5. A fluid dispensing nozzle as in claim 4 wherein said tabs include inner surfaces which are angled inwardly to further facilitate assembly of the disk on the diaphragm support.

6. A fluid dispensing nozzle as in claim 4 wherein the diaphragm support is formed of a molded polymeric material.

7. A fluid dispensing nozzle as in claim 3 wherein the pin is compositely formed and comprises a central pin member having an upper and a lower end and abutment means formed adjacent its upper end and a second pin member telescoped over the lower end of said central pin member and engageable with said abutment means, and said downwardly facing shoulder is formed on said second pin member.

8. A fluid dispensing nozzle as in claim 7 wherein the disk, the diaphragm support and the central member are formed of a molded polymeric resin, and the second pin member is formed of a metal material.

* * * * *